United States Patent [19]

Braun et al.

[11] 4,400,292

[45] Aug. 23, 1983

[54] PROCESS FOR MAKING AGENTS FOR DESULFURIZING CRUDE IRON OR STEEL MELTS

[75] Inventors: Albert Braun, Hürth; Willi Portz; Georg Strauss, both of Erftstadt; Hans-Martin Delhey, Duisburg, all of Fed. Rep. of Germany

[73] Assignee: Hoechst Aktiengesellschaft, Fed. Rep. of Germany

[21] Appl. No.: 359,229

[22] Filed: Mar. 18, 1982

[30] Foreign Application Priority Data

Mar. 24, 1981 [DE] Fed. Rep. of Germany ..... 3111509

[51] Int. Cl.[3] ..... C01B 31/32; C21C 1/02

[52] U.S. Cl. ..... 252/189; 75/6; 75/55

[58] Field of Search ..... 252/189; 75/6, 55

[56] References Cited

U.S. PATENT DOCUMENTS

| | | | |
|---|---|---|---|
| 3,192,037 | 6/1965 | Haucke et al. | 75/55 |
| 3,473,917 | 10/1969 | Michaelis | 75/55 |
| 3,884,679 | 5/1975 | Mittoldorf | 75/55 |
| 4,054,445 | 10/1977 | Ramacciotti | 75/55 |
| 4,194,902 | 3/1980 | Gmohling | 75/55 |
| 4,318,822 | 3/1982 | Braun et al. | 252/189 |

*Primary Examiner*—Irwin Gluck

*Attorney, Agent, or Firm*—Connolly and Hutz

[57] ABSTRACT

The disclosure relates to a process for the manufacture of desulfurizing agents containing 1-6 weight % chemically combined water, based on calcium oxide and carbon-containing calcium carbide, for crude iron and steel melts. More particularly, the disclosure provides for a molten mixture of calcium carbide and calcium oxide containing 20 to 80 weight % CaO to be made from lime and coke; for the mixture to be allowed to cool and solidify into a block; for the solidified block while it still has an average temperature of more than 400° C. to be crushed to particles with a size of less than 150 mm; for the comminuted mixture, which still has a temperature of at least 400° C. to be admixed with a quantity of calcium oxide necessary to establish in the resulting mixture a total content of CaO corresponding to the CaO content desired in the end product; and for the mixture to be gound while intensively mixing it with free carbon and carbonate in the presence of air or nitrogen with a moisture content of 5 to 20 g/m$^3$ (at 1.013 bar and 273.15 K.) at temperatures below 100° C. to particles with a size of less than 10 mm.

9 Claims, No Drawings

PROCESS FOR MAKING AGENTS FOR DESULFURIZING CRUDE IRON OR STEEL MELTS

The present invention relates to a process for the manufacture of desulfurizing agents containing 1–6 weight % chemically combined water, based on calcium oxide and carbon-containing calcium carbide, for crude iron and steel melts.

The desulfurization of crude iron and steel melts by means of calcium carbide (referred to hereinafter as carbide) containing calcium oxide (briefly referred to hereinafter as lime) and carbon, if desired, is generally known (DE-PS No. 11 60 457, DE-PS No. 20 37 758, DE-PS No. 22 36 160).

Heretofore, it has been customary to prepare these desulfurizing agents by processes, wherein the necessary quantity of finely divided lime was introduced into molten carbide in order to produce a homogeneous mixture in the melt, which was then allowed to cool and was comminuted.

Preferably, the finely divided lime was introduced into the stream of carbide tapped off from the furnace. Although the quantity of lime that can be introduced into the carbide melt is limited and there are risks associated with working with liquid carbide, it has long been held in the art that this method could not be avoided since it was thought that only a mixture of $CaC_2$ and CaO produced in the melt was ideally suited for desulfurization of metal melts.

Calcium carbide based desulfurizing agents containing substances which split off water at the temperature of the metal melt have already been described in DE-AS No. 22 52 795. These agents, which are mixtures of customary commercial carbide with, for example, $Ca(OH)_2$ as the substance splitting off water, and carbon, if desired, have the disadvantage that they are mechanical blends in which carbide particles exist separately from the $Ca(OH)_2$ particles. The use of these products means higher consumption, involves irregular and vigorous gas reactions and desulfurizing efficiency, varying within wide limits. In other words, the controlled use of these products is rendered difficult.

The present invention now unexpectedly provides a process for making a highly effective desulfurizing agent for crude iron and steel melts which process permits the disadvantages of prior art methods to be avoided and which comprises: thermally producing from line and coke a molten feed mixture of carbide and calcium oxide with a CaO content varying within the range 20 to 80 weight %; allowing the mixture to cool and solidify into a block; rough-crushing the solidified block while it still has an average temperature of more than 400° C., preferably of between 400° C. and the solidification temperature of the melt, to particles with a size of less than 150 mm; admixing the comminuted mixture, which still has a temperature of at least 400° C., with a quantity of calcium oxide necessary to establish in the mixture a total content of CaO corresponding to the CaO content desired in the end product. Preferably, calcium oxide is added in a quantity necessary to establish in the mixture a total content of CaO of more than 45% up to 90% by weight. Next, the mixture is ground, while being intensively mixed with free carbon and carbonate, in the presence of air or nitrogen having a moisture content of 5 to 20 g/m$^3$ (at 1.013 bar and 273.15K) at temperatures below 100° C., preferably at 10°–50° C., to particles with a size of less than 10 mm, preferably of less than 0.1 mm.

In the event of free carbon and carbonate being used, it is preferable for them to be added in the quantities necessary for the final product to contain 0.5 to 8 weight % free carbon and 0.5 to 20 weight % carbonates of calcium, magnesium or sodium.

A preferred feature of the present process provides for the molten feed mixture of calcium carbide and calcium oxide to contain 20 to 45 weight % CaO, the mixture being made from lime and coke in known manner by thermal treatment. It is also possible, however, initially to produce a molten feed mixture of calcium carbide and calcium oxide with a CaO content of more than 45% up to 80% by weight, by introducing finely divided calcium oxide into an existing calcium carbide melt containing up to 45 weight % CaO until establishment of a maximum CaO content of up to 80 weight %, then allowing the whole to solidify into a block, and rough-crushing the latter at temperatures of above 400° C.

The present process permits inhibiting mixing the lime with a carbide melt and the difficulties associated therewith. In addition to this, the present process has, inter alia, the following beneficial effects: It is not necessary for the composition of the burden to be set in each particular case for producing the carbide melt, nor is it necessary for the lime to be first ground to a certain particle size. Use can rather be made of a carbide block with a $CaC_2$:CaO weight ratio which may vary within wide limits. In other words, the carbide block may contain $CaC_2$ and CaO in practically any ratio, and the lime can even be used in the form of coarse particles with a size within the range 8 to 60 mm, for example.

A further beneficial effect of the agent produced in accordance with this invention resides in the fact that on the surface each individual particle of $Ca(OH)_2$ lies close to $CaC_2$, with the result that the desulfurizing reaction is started very early and regularly. As a result of this, smaller quantities of desulfurizing agents are required to be used than heretofore, for producing comparable desulfurization results, which incidentally are controllable.

EXAMPLE 1

The feed material was a melt as customarily used for the manufacture of commercial carbide, the melt containing 80 weight % $CaC_2$ and 20 weight % CaO. A carbide block of corresponding composition was produced in known manner in a crucible by allowing this melt to cool.

After the block had cooled to an average temperature of about 600° C., it was rough-crushed to particles with a size of less than 150 mm and the carbide, still with a temperature of 500° C., was covered with a layer of sufficient lime with a particle size of 8 to 60 mm so that the resulting mixture contained altogether 50 weight % CaO.

Next, 850 kg of this mixture was admixed with 100 kg limestone (particle size smaller than 1 mm) and 50 kg coke breeze (particle size smaller than 3 mm) and the whole was ground in a rotary mill, while 1500 m$^3$/h of air with a moisture content of 10 g/m$^3$ (at 15° C.) was passed therethrough. The throughput was 500 kg/h at 50° C., and the mixture was ground to particles with a size of up to 0.1 mm. The ground product contained 2 weight % chemically combined water.

1500 kg of this product was used for customary desulfurization of 300 000 kg of a crude iron melt that contained 0.03 weight % sulfur. The iron so treated contained less than 0.005 weight % sulfur.

EXAMPLE 2

Calcium carbide was thermally produced in known manner from lime and coke, the lime/coke mixture in the total burden being set at a weight ratio of about 110:40, corresponding to a carbide with a CaO content of about 45 weight %.

CaO of a particle size of 3–8 mm was metered into the carbide tapped off, the CaO being used in a quantity necessary for the carbide tapped off into the crucible to contain CaO in an average proportion of about 80 weight % (approximately 1.2–1.3 t CaO per metric ton material tapped off):

After cooling the crucible to an average temperature of no less than 600° C., which was the case after 4 hours, the block was rough-crushed to particles with a size of less than 150 mm and a layer of sufficient lime of particles with a size of 8 to 60 mm was added to the hot mixture that the average CaO content was 90 weight %.

Next, 875 kg of this mixture was admixed with 100 kg limestone (particles smaller than 1 mm) and 25 kg coke breeze (particles smaller than 3 mm), and the whole was ground in a rotary mill, while 1500 $m^3/h$ of air with a moisture content of 10 $g/m^3$ (at 15° C.) was passed therethrough. The throughput was 500 kg/h at 50° C. and the material was ground to particles with a size of less than 0.1 mm. The final product contained 2.5 weight % chemically combined water.

The mixture permitted the same desulfurization results as those described in Example 1 to be produced, based on the calcium carbide content.

We claim:

1. A process for the manufacture of desulfurizing agents containing 1–6 weight % chemically combined water, based on calcium oxide and carbon-containing calcium carbide, for crude iron and steel melts, which comprises: producing from lime and coke a molten mixture of calcium carbide and calcium oxide containing 20 to 80 weight % CaO; allowing the mixture to cool and solidify into a block; rough-crushing the solidified block while it still has an average temperature of more than 400° C. to particles with a size of less than 150 mm; admixing the comminuted mixture, which still has a temperature of at least 400° C., with a quantity of calcium oxide necessary to establish in the resulting mixture a total content of CaO corresponding to the CaO content desired in the end product; and then grinding the mixture while intensively mixing it with free carbon and carbonate in the presence of air or nitrogen with a moisture content of 5 to 20 $g/m^3$ (at 1.013 bar and 273.15K) at temperatures below 100° C. to particles with a size of less than 10 mm.

2. A process as claimed in claim 1, wherein the final product contains 0.5 to 8 weight % free carbon and 0.5 to 20 weight % carbonates of calcium, magnesium or sodium.

3. A process as claimed in claim 1, wherein coarse particles of CaO with a size of 8 to 60 mm are added to the rough-crushed mixture.

4. A process as claimed in claim 1, wherein a quantity of CaO sufficient to produce a mixture containing more than 45 up to 90 weight % CaO, is added to the rough-crushed mixture.

5. A process as claimed in claim 1, wherein the mixture is rough-crushed at temperatures of between 400° C. and the solidification temperature.

6. A process as claimed in claim 1, wherein the molten feed mixture of calcium carbide and calcium oxide with a CaO content of 20 to 45% by weight is produced from lime and coke in customary manner by thermal treatment.

7. A process as claimed in claim 1, wherein the molten feed mixture of calcium carbide and calcium oxide with a CaO content of more than 45 up to 80 weight % is produced by introducing finely divided calcium oxide into an existing calcium carbide melt containing up to 45 weight % of CaO until establishment therein of a CaO content of at most 80 weight %, and then allowing the whole to solidify into a block.

8. A process as claimed in claim 1, wherein the mixture is ground at 10°–50° C. to particles with a size of less than 10 mm.

9. A process as claimed in claim 1, wherein the mixture is ground to particles with a size of less than 0.1 mm.

* * * * *